United States Patent [19]

Gysin

[11] Patent Number: 5,052,446

[45] Date of Patent: Oct. 1, 1991

[54] THERMOPLASTIC HEDDLE WITH BRAIDED FIBER TUBE REINFORCEMENT

[75] Inventor: Hans J. Gysin, Winterthur, Switzerland

[73] Assignee: Sulzer Brothers Limited, Winterthur, Switzerland

[21] Appl. No.: 527,045

[22] Filed: May 22, 1990

[30] Foreign Application Priority Data

Jun. 12, 1989 [CH] Switzerland ..... 02188/89

[51] Int. Cl.[5] ..... D03C 9/02

[52] U.S. Cl. ..... 139/93; 138/123; 156/149; 428/36.3

[58] Field of Search ..... 428/36.1, 255, 253, 428/174, 175, 36.3; 138/123, 124, 125; 156/149; 139/93, 91; 242/131

[56] References Cited

U.S. PATENT DOCUMENTS

| | | | |
|---|---|---|---|
| 3,049,151 | 8/1962 | McFetters | 139/93 |
| 4,299,359 | 11/1981 | Shelton | 242/131 |
| 4,907,624 | 3/1990 | Jonasson | 138/123 X |
| 4,961,977 | 10/1990 | Archer et al. | 138/123 X |

FOREIGN PATENT DOCUMENTS

| | | | |
|---|---|---|---|
| 0851029 | 9/1952 | Fed. Rep. of Germany . | |
| 875216 | 9/1942 | France | 139/93 |
| 1192175 | 10/1959 | France . | |
| 2267403 | 11/1975 | France . | |
| WO80/00719 | 4/1980 | PCT Int'l Appl. . | |
| 1027328 | 4/1966 | United Kingdom | 139/93 |

*Primary Examiner*—Andrew M. Falik

*Attorney, Agent, or Firm*—Kenyon & Kenyon

[57] ABSTRACT

A rod-like yarn guiding heald is made of a compact thermoplastic reinforced with industrial continuous fibers. The fiber reinforcement is in the form of a flattened braided flexible tube. An eye opening is contrived by opening up the braided fiber strands. The yarn guiding heald is of light weight and high strength. A ceramic insert may also be inserted into the opening of the yarn guiding heald for special yarns.

17 Claims, 3 Drawing Sheets

(A-A)

(A-A)

(B-B)

THERMOPLASTIC HEDDLE WITH BRAIDED FIBER TUBE REINFORCEMENT

Figure 1:
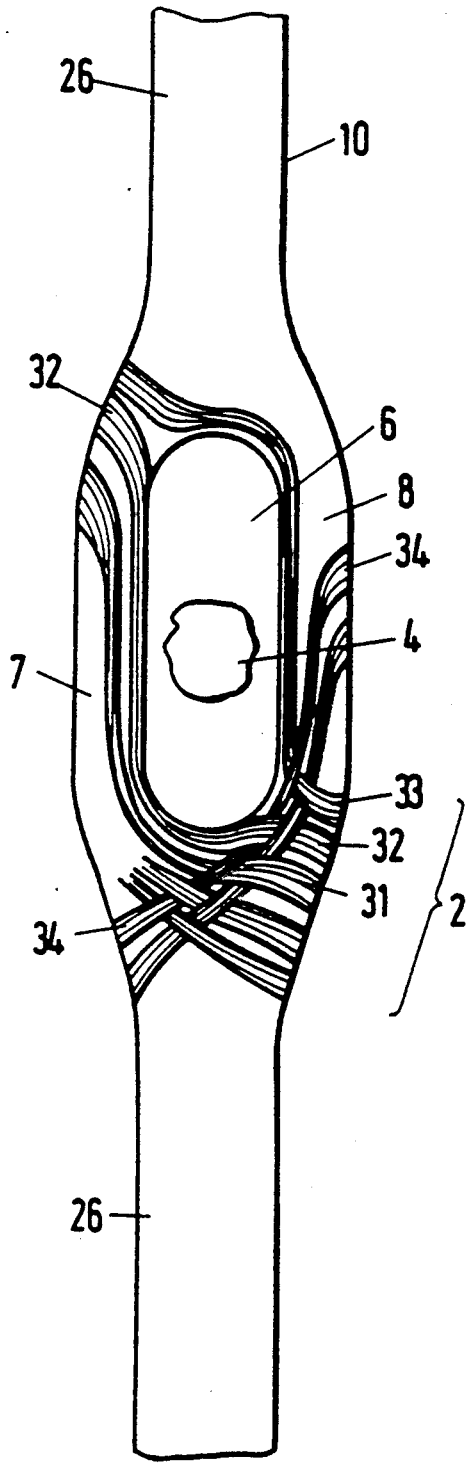

This invention relates to a rod-like yarn guiding element for textile machinery and to a method of making the same. More particularly, this invention relates to a heald for a loom.

As is known, various types of yarn guiding elements for textile machinery, particularly healds for looms, have been known, for example, for guiding warp yarns during shedding in looms. Frequently, these yarn guiding elements have been made of flat steel stampings or have been made by bending steel wire. However, in addition to being relatively heavy, these known metal yarn guiding elements are complex to produce. The main factor responsible for the relatively elaborate and expensive production being the provision, if necessary by means of a separate ceramic eye insert, of an appropriately shaped yarn eye which does not damage the yarn. Further, the relatively high weight of metal yarn guiding elements is increasingly becoming a problem in modern high-speed textile machinery.

It has also been known, for example, from International Patent Application W080/00719 to form healds of plastic material. In this case, the plastic material has been molded into an elongated body with openings disposed, for example, at intermediate zone for the passage of a yarn. In addition, it has been known to place a thread guide ring of case-hardened or stainless steel in the opening. However, such plastic healds do not have a particularly high strength.

French Patent 2,267,403 also describes various elongated structures which have been used for yarn guiding elements Again, these structures may be made of flexible materials which are provided with separate inserts in order to provide for the guiding of yarns therethrough.

Accordingly, it is an object of the invention to provide a light-weight, yarn-guiding element of high strength.

It is another object of the invention to provide a yarn guiding element which is simple to produce without any loss of strength and yarn compatibility It is another object to the invention to provide a relatively simple technique for making a yarn-guiding element of strong light-weight construction.

Briefly, the invention provides a rod-like yarn guiding element for textile machinery which is comprised of an elongated compact thermoplastic body having an eye opening in an intermediate zone and a braided tube of industrial continuous fibers reinforcing the plastic body. In addition, the tube has the fibers thereof disposed about the opening in the intermediate zone of the thermoplastic body. In this respect, the braided fiber strands are opened up about the opening in order to pass about the opening while reinforcing the portions of the intermediate zone about the opening.

The composition and arrangement of the material of the yarn guiding element, if nothing else, helps to reduce weight quite considerably. Also, the thermoplastic matrics of the body and the braided construction of the tube help to improve the shaping of the element and reduce the material needed. This further reduces costs as well as weight. The production, particularly the shaping of the yarn eye and of the end zones can be considerably simplified. To the same, the invention also provides a method of making a rod-like yarn guiding element. In a first stage, an elongated structure is formed of a continuous fiber reinforced plastic while the fibers are held in tension. Thereafter, in a second stage, the fibers and thermoplastic of the elongated structure are thermoplastically reshaped to form an opening in an intermediate zone of the structure for passage of the yarn therethrough. The method may also include an intermediate step of cutting the structure to a predetermined length between the two forming stages.

The yarn guiding elements provided may be clamped as healds in shaft frames, something which is virtually impossible with conventional steel healds. This is achieved as a result of greatly increased stretch resulting from the composition of the material and the fiber angle of the braiding. For example the fibers may be held in tension during the first stage of forming the elongated structure while also being disposed on an inclined angle relative to the longitudinal axis of the body. This feature, permits for the first time, the achievement in practice of a uniform tensioning of all the healds which remains sufficiently constant during rapid shaft movements over the relatively considerable weaving width. Thus, the clearance conventionally necessary with loose-fit steel healds can therefore be eliminated. This factor can lead to further advantages depending on the particular use concerned.

As a result of the simple thermoplastic reshaping, a additional eye insert of any kind can be inserted into the opened up eye opening of the thermoplastic body.

The thermoplastic material may be selected from the group consisting of polyetheretherketone (PEEK);. polyphenylenesulfide (PPS); polypropylene (PP); and polyamide (PA). The fibers may be selected from the group consisting of carbon, aramide and glass. In addition, the fibers should constitute at least 45% by volume of the element. As noted above, the fibers may be disposed on an inclined angle relative to the longitudinal axis of the body. For example, the fiber angle should be less than 45 degrees relative to the longitudinal axis of the body in order to provide high strength and high stretch.

The yarn guiding element may be fabricated so that the elongated thermoplastic body has an opening at each end with the fibers of the braided tube displaced about each opening. Further, the body may be made with a loop-like end, a hook-shaped end or a clip-like end. These may be shaped in a simple thermoplastic shaping stage. Equally simply, a twist can be contrived thermoplastically in the intermediate zone of the yarn guiding element. For example, where the body is made of flat cross-sectional shape, the intermediate zone is twisted relative to the end zones of the body. This can lead to improved use of space in the case of dense woven fabrics in a loom.

In producing the yarn-guiding elements, long lengths can be produced in a first stage from thermoplastic impregnated UD-rovings, for example, in the form of a Prepreg flexible tubular braiding in a pultrusion apparatus. This method is very simple and efficient.

Figure 2A:
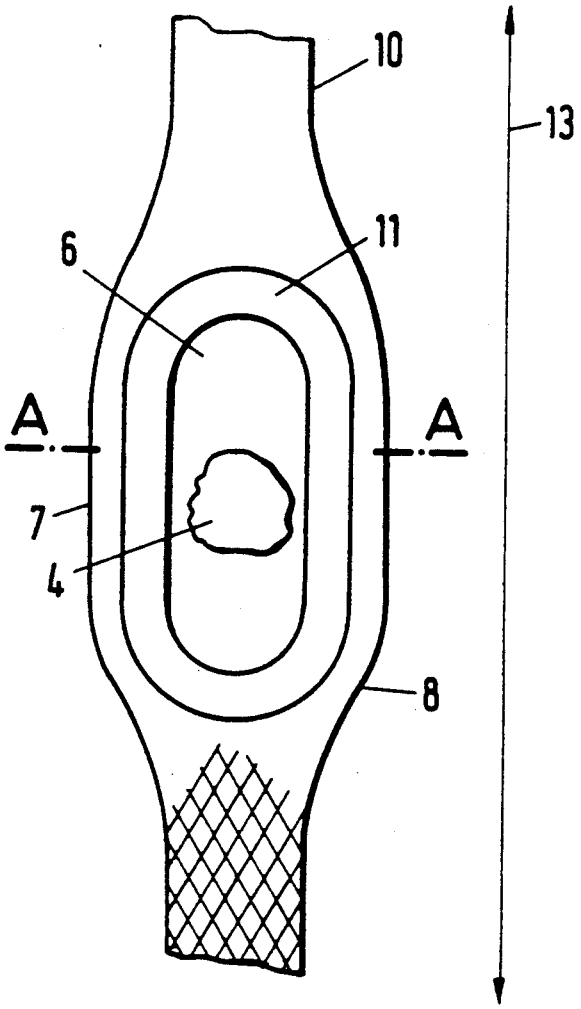
Figure 2B:
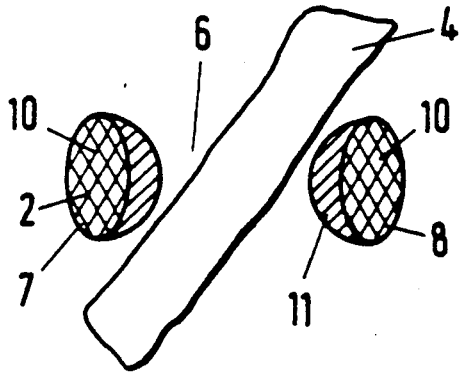

These and other objects and advantages of the invention will become more apparent from the following detailed description taken in conjunction with the accompanying drawings wherein:

FIG. 1 illustrates a part of a yarn guiding element formed with an eye opening in accordance with the invention;

FIG. 2*a* illustrates a view of a yarn guiding element with an additional eye insert for use as a heald;

FIG. 2*b* illustrates a view taken on line A—A of Fig. 2*a;*

Figure 3A:
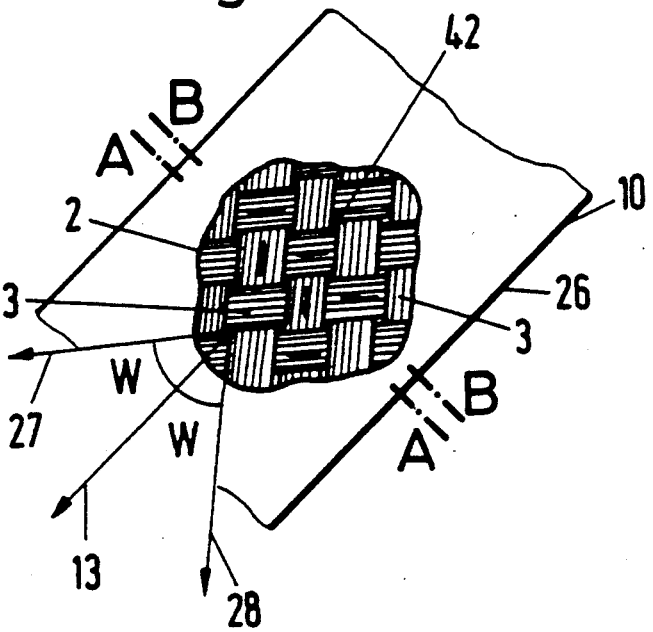
Figure 3B:
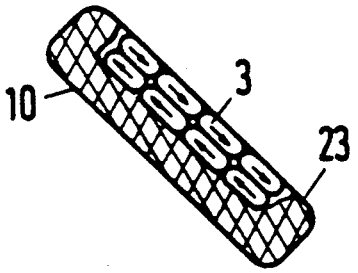

FIG. 3*a* schematically illustrates the inclined angles of the fibers of the tubular braiding used in the yarn guiding element in accordance with the invention;

FIG. 3*b* illustrates a schematic view taken on line A—A of FIG. 3*a;*

Figure 3C:
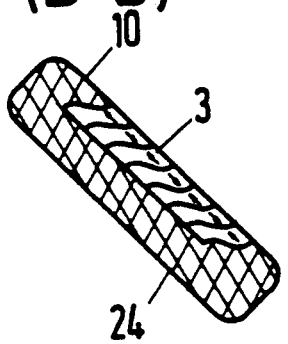

FIG. 3*c* illustrates a schematic view taken on line B—B of FIG. 3*a;*

Figure 3D:
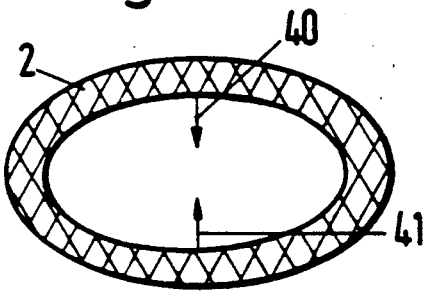
Figure 4B:
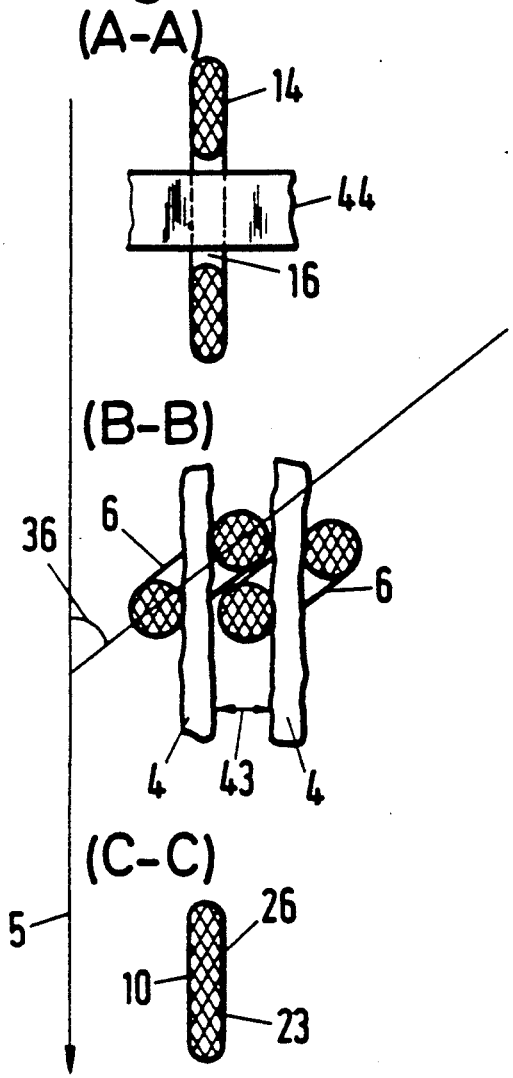
Figure 4A:
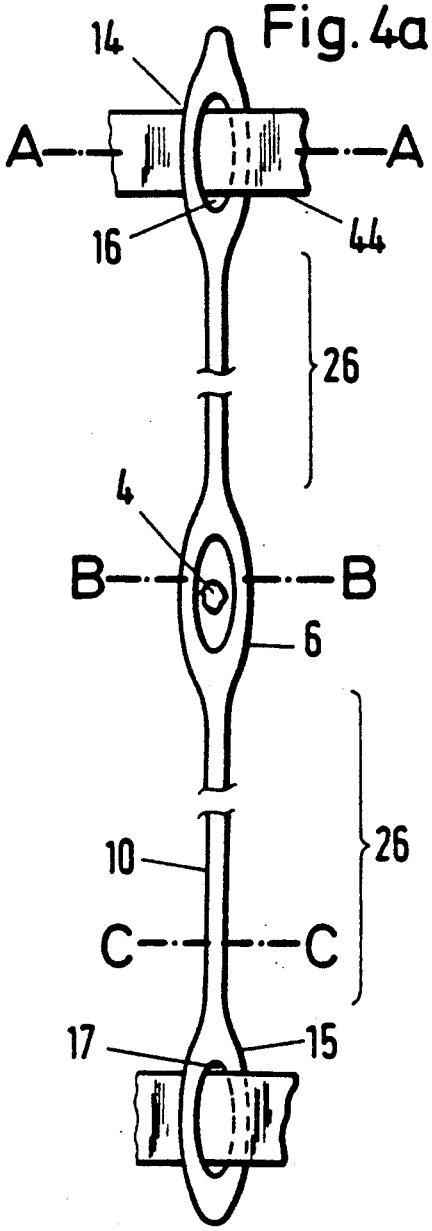

FIG. 3*d* illustrates a cross-sectional view of a braided tube of continuous fibers prior to pressing into a flattened condition in accordance with the invention;

FIG. 4*a* illustrates a heald constructed in accordance with the invention;

FIG. 4*b* illustrates a series of views taken on lines A—A, B—B and C—C of FIG. 4*a;*

Figure 5A:
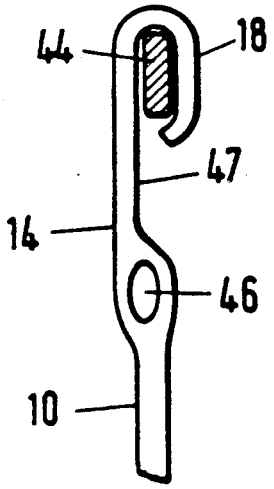
Figure 5B:
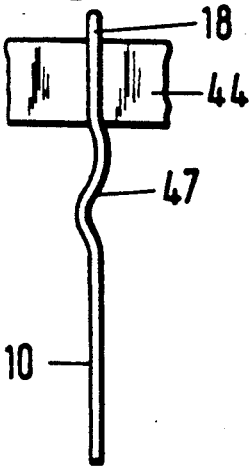

FIG. 5*a* illustrates a view of an end zone of a heald constructed in accordance with the invention;

FIG. 5*b* illustrates a side view of the heald of 5*a;*

Figure 6:
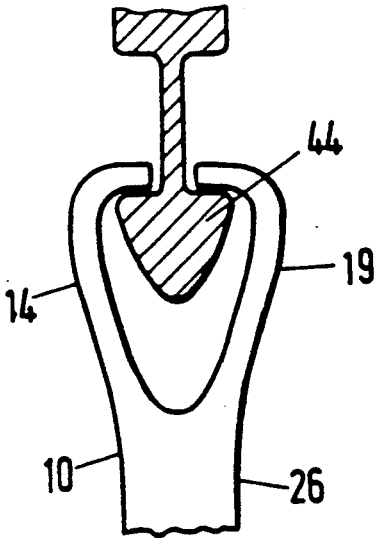
Figure 7:
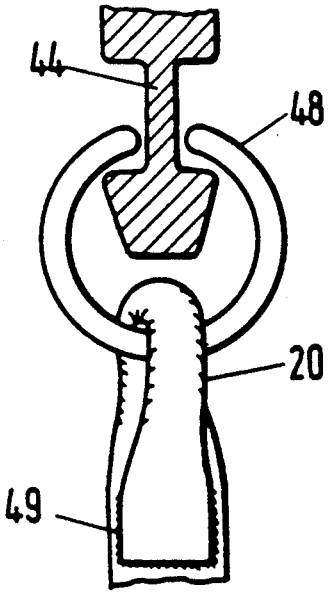

FIG. 6 illustrates a clip-like end zone of a yarn guiding element constructed in accordance with the invention; and FIG. 7 illustrates a loop-like end zone of a yarn guiding element constructed in accordance with the invention;

Referring to FIG. 1, the rod-like guiding element 10 is formed of an elongated flat compact thermoplastic body having a transversely oriented eye opening 6 in an intermediate zone between two straight zones 26 and which is effective as a heald to guide a warp yarn. In addition, the element 10 includes a flattened braided tube 2 of industrial continuous fibers which reinforces the thermoplastic body. In a sense, the compact body of the heald 10 is formed by a fiber composition consisting of a thermoplastic matrix and a flexible tubular braiding.

As indicated in FIG. 1, the tubular braiding 2 has discrete fiber strands 31, 32, 33, 34 which divide in the eye zone; two strands, 31, 32 extend in a branch 7 on the left and two strands 33, 34 extend in a branch 8 on the right. This braiding of the fiber strands in the eye zone 6 prevents the eye from tearing, such as would happen with unidirectional fiber structures. The braiding also provides the necessary smooth yarn-compatible surface in the eye 6 by insuring that individual fibers cannot spread out and damage or catch a yarn 4 passing through the opening 6. Because of the thermoplastic matrix, the form of the opening 6 can be ideally rounded and optimized to yarn movement (see FIG. 4).

Referring to FIG. 2*a,* wherein like reference characters indicate like parts as above, an additional eye insert 11, for example, a ceramic yarn eye, may be inserted into the opening 6 in order to be specially adapted in material and shape to particular yarns. To this end, the eye zone is heated, the eye opening 6 is opened up plastically, the insert 11 is inserted and then fixed and cooled by tensioning the body 10 along the longitudinal axis 13. The insert 11 is therefore fixed securely without additional steps and ancillary materials, such as would be necessary, for example, in the soldering of inserts in steel healds, and without imparing the strength of the yarn guiding element 11. For a given strength the yarn guiding element 10 may provide, for example, a fivefold weight reduction as compared with conventional steel healds.

As schematically indicated in FIG. 2*b*, the yarn 4 passing through the eye opening 6 is presented with rounded surfaces on the insert 11 within the branches 7, 8 of the yarn guiding element 10.

Referring to FIG. 3*d*, the braided tube 2 of continuous fibers is initially flattened by being pressed flat in the directions indicated by the arrows 40, 41 and is consolidated into a compact unit. As indicated in FIGS. 3*a*, 3*b* and 3*c*, the various strands 3 of fibers in each layer of the flattened tubes are disposed in two directions indicated by the arrows 27, 28 so as to form an inclined angle W of preferrably less than 45 degrees, for example, from 30 degrees to 40 degrees, relative to the longitudinal axis 13 of the yarn guiding element 10. The resilient properties of the flattened tube 2 can be varied and optimized by the choice and adjustment of the angle W during production by appropriate tensioning, something which is impossible with conventional steel healds. Of note, FIGS. 3*b* and 3*c* schematically illustrate the cross-sections 23, 24 respectively of the strands 3.

During the thermoplastic reshaping of the opening 6 in the thermoplastic body, the opening up of the strands of fibers, for example, by means of an appropriate mandrel, or the like, can be perfomred with advantage by inserting the mandrel between the strands, for example, at a point 42 of the polymer matrix where the strands are disposed in crossing relation (see FIG. 3*a*).

Referring to FIG. 4*a*, the yarn guiding element may be constructed for use as a heald having an intermediate zone with an eye opening 6, two flat uninterruped zones 26 and two flat end zones 14, 15, each of which is provided with an opening in a similar manner. In addition, as indicated in FIG. 4*b*, the intermediate zone may be provided with a twist 36, for example, of 45 degrees relative to the yarn axis 5, as viewed from above, as well as relative to the respective end zones 14, 15. As indicated, each end zone 14, 15 is provided with an opening 16, 17 similar to the opening 6.

An advantageous dense arrangement of a plurality of healds with a reduced yarn separation 43 (see FIG. 4*b*) can therefore be achieved in the eye zone.

As indicated in FIG. 4*a*, the heald 10 is flattened and extends parallel to the axis 5 of the yarns in the straight zones 26 and in the end zones 14, 15. In this example, the openings 16, 17 of the end zones are threaded onto mountings 44 of heald shafts (not shown). Alternatively, the thermoplastic yarn-guiding elements 10 can be shaped as required in the respective end zones.

Referring to FIGS. 5*a* and 5*b*, a yarn guiding element 10 may be provided with a hooked end zone 18, for example, for mounting over a mounting 44 of a heald frame. In addition, a handling open 46 may be provided in the end zone along with a molded resilient bend 47 (see FIG. 5*b*).

Referring to FIG. 6, a yarn guiding element 10 may b provided with a resilient clip-like end zone 19 which can be simply pushed onto a heald mounting 44 as if onto a curtain rail. This facilitates the replacement of the individual healds. Alternatively, as shown in FIG. 7, the end zone may be provided with a loop-like part 20 having a matrix welded on itself at an end point 49. In addition, a push-on circlip or the like 48 may be disposed within the loop-like part 20 for clipping onto a heald mounting 44.

The yarn guiding element can be embodied and used in textile machinery in various way. For example, the yarn guiding element may have more than one yarn eye and may have, for example, two yarn eyes offset from one another for the top fabric and bottom fabric in healds for ribbon weaving. The yarn guiding element may also be used, with appropriate thermoplastic shaping of the end zones, as a stop motion lamella in a loom.

In order to make the yarn guiding element, an elongated structure is first formed of a continuous fiber reinforced thermoplastic while the fibers are held in tension. To this end, after flattening of the braided tube 2 as indicated in FIG. 3*d*, a impregnating of the tube 2 with a the strands 3 (see FIG. 3*a*) in tension. After thermoplastic shaping, a mandrel as noted above, can be inserted into the resulting structure so as to separate the fiber strands in a manner as indicated in FIG. 1 so as to reshape the fibers and the thermoplastic in a second stage to form the opening 6 for passage of a yarn therethrough. This second stage may be preceded by the cutting of the structure to a predetermined length.

The invention thus provides a yarn guiding element of light weight construction and of high strength. Further, the, invention provides a yarn guiding element which can be readily used as a heald within a minimum of space.

The invention also provides a relatively simple and inexpensive technique for the formation of yarn guiding elements in a two-stage thermoplastic process. In this respect, the yarn guiding elements may be made in almost any shape.

What is claimed is:

1. A rod like yarn guiding element for textile machinery comprising an elongated compact thermoplastic body of flat cross-sectional shape, having a transversely oriented eye opening in an intermediate zone for passage of a yarn therethrough; and a braided tube or continuous fibers reinforcing said thermoplastic body, said tube having said fibers thereof disposed about said opening.

2. An element as set forth in claim 1 which further includes an insert disposed in said opening of said body for passage of a yarn therethrough.

3. An element as set forth in claim 1 wherein said body is made of a thermoplastic material selected from the group consisting of PEEK, PPS, PP and PA.

4. An element as set forth in claim 1 wherein said fibers are made of a material selected from the group consisting of carbon, aramide and glass.

5. An element as set forth in claim 1 wherein said fibers constitute at least 45 percent by volume of said element.

6. An element as set forth in claim 1 wherein said fibers are disposed on an inclined angle relative to a longitudinal axis of said body less than 45 degrees.

7. An element as set forth in claim 1 wherein said body has an opening at each end thereof and said fibers of said tube are disposed about said opening.

8. An element as set forth in claim 1 wherein said body has at least one loop-like end.

9. An element as set forth in claim 1 wherein said body has at least one hook-shaped end.

10. An element as set forth in claim 1 wherein said body has at least one clip-like end.

11. A heald for a loom comprising an elongated flat thermoplastic body having an traverse opening for passage of a yarn therethrough in a intermediate zone thereof, a pair of end zones and an opening in each end zone; and a flattened braided tube of continuous fibers extending longitudinally of and within said body to reinforce said body, said tube having crossing strands of fibers thereof displaced about each said opening of said intermediate zone and a respective end zone.

12. A heald as set forth in claim 11 which further comprises a ceramic yarn eye mounted in said opening of said body.

13. A heald as set forth in claim 11 wherein said body is of rectangular cross-section with said intermediate section angularly disposed relative to end zones of said body.

14. A rod like yarn guiding element for textile machinery comprising an elongated compact thermoplastic body having a transversely oriented eye opening in an intermediate zone for passage of a yarn therethrough; and a braided tube of continuous fibers reinforcing said thermoplastic body and disposed about said opening, said tube having said fibers thereof disposed on an inclined angle of less than 45 degrees relative to a longitudinal axis of said body.

15. An element as set forth in claim 14, wherein said fibers constitute at least 45 percent by volume of said element.

16. An element as set forth in claim 14, wherein said body has an opening at each end thereof and said fibers of said tube are disposed about each said opening.

17. A rod like yarn body element for textile machinery comprising an elongated compact thermoplastic body of flat cross-sectional shape having a transversely oriented eye opening in an intermediate zone for passage of a yarn therethrough, said intermediate zone being twisted relative to a pair of end zones of said body; and a braided tube of continuous fibers reinforcing said thermoplastic body, said tube having said fibers thereof disposed about said opening.

* * * * *

UNITED STATES PATENT AND TRADEMARK OFFICE

CERTIFICATE OF CORRECTION

PATENT NO. : 5,052,446

DATED : October 1, 1991

INVENTOR(S) : Hans J. GYSIN

It is certified that error appears in the above-identified patent and that said Letters Patent is hereby corrected as shown below:

Col. 2, line 28, change "a" to --an--.

Col. 3, line 63, change "strength" to --strength,--.

Col. 4, line 53, change "b" to --be--.

Col. 5, line 9, change "a the" to --a suitable thermoplastic, the tube is stretched so as to place the--.

Col. 5, line 36, change "or" to --of--.

Signed and Sealed this

Fourteenth Day of June, 1994

*Attest:*

Bruce Lehman

BRUCE LEHMAN

*Attesting Officer*

*Commissioner of Patents and Trademarks*